US010230197B2

(12) United States Patent
Saur et al.

(10) Patent No.: US 10,230,197 B2
(45) Date of Patent: Mar. 12, 2019

(54) CONNECTOR POSITION ASSURANCE (CPA) AND PLUG CONNECTOR ARRANGEMENT HAVING A CPA

(71) Applicant: Robert Bosch GmbH, Stuttgart (DE)

(72) Inventors: Martin Saur, Salach (DE); Jens Oberender, Boebingen an der Rems (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/301,382

(22) PCT Filed: Mar. 12, 2015

(86) PCT No.: PCT/EP2015/055203
§ 371 (c)(1),
(2) Date: Oct. 1, 2016

(87) PCT Pub. No.: WO2015/150048
PCT Pub. Date: Oct. 8, 2015

(65) Prior Publication Data

US 2017/0125949 A1 May 4, 2017

(30) Foreign Application Priority Data

Apr. 3, 2014 (DE) ..... 10 2014 206 431

(51) Int. Cl.
*H01R 13/641* (2006.01)
*H01R 13/627* (2006.01)
(Continued)

(52) U.S. Cl.
CPC ..... *H01R 13/64* (2013.01); *H01R 13/4361* (2013.01); *H01R 13/6272* (2013.01)

(58) Field of Classification Search
CPC ..... H01R 13/641; H01R 13/4361; H01R 13/6272
(Continued)

(56) References Cited

U.S. PATENT DOCUMENTS 5,605,471 A * 2/1997 Plyler ..... H01R 13/641 439/352
6,491,542 B1 * 12/2002 Zerebilov ..... H01R 13/4226 439/352
7,402,069 B2 * 7/2008 Shigeta ..... H01R 13/641 439/352
8,628,344 B2 * 1/2014 Cole ..... H01R 13/6272 439/352
(Continued)

FOREIGN PATENT DOCUMENTS

CN 103201910 A 7/2013
DE 601 03 839 T2 7/2005
(Continued)

OTHER PUBLICATIONS

International Search Report corresponding to PCT Application No. PCT/EP2015/055203, dated May 22, 2015 (German and English language document) (5 pages).

*Primary Examiner* — Briggitte R Hammond
(74) *Attorney, Agent, or Firm* — Maginot, Moore & Beck LLP

(57) ABSTRACT

A connector position assurance (CPA) for ensuring the contact position of a plug housing on a mating plug housing includes a housing configured to be pushed onto the plug housing in a mounting direction and a locking element configured to block a latching element of the plug housing. The housing of the CPA has a passage opening configured to receive the plug housing during the mounting process. The locking element is arranged on the housing of the CPA and has a free end that extends along the mounting direction. The
(Continued)

locking element is offset toward the outside transverse to the mounting direction in relation to the housing of the CPA in order to keep the risk of interlocking as low as possible. A plug connector arrangement includes the CPA.

19 Claims, 9 Drawing Sheets

(51) Int. Cl.
*H01R 13/436* (2006.01)
*H01R 13/64* (2006.01)

(58) Field of Classification Search
USPC ..... 439/352, 489
See application file for complete search history.

(56) References Cited

U.S. PATENT DOCUMENTS

| | | | | |
|---|---|---|---|---|
| 2003/0045161 | A1 | 3/2003 | Endo et al. | |
| 2013/0095692 | A1 | 4/2013 | Cole | |
| 2014/0004732 | A1* | 1/2014 | Heil ..... | H01R 13/6275 439/352 |

FOREIGN PATENT DOCUMENTS

| | | | |
|---|---|---|---|
| DE | 60 2005 000 248 | T2 | 9/2007 |
| JP | 3-274687 | A | 12/1991 |
| JP | 4-12479 | A | 1/1992 |
| JP | 11-167958 | A | 6/1999 |
| JP | 2003-157932 | A | 5/2003 |
| JP | 2006-260920 | A | 9/2006 |
| JP | 2007-128743 | A | 5/2007 |
| JP | 2013-214495 | A | 10/2013 |

* cited by examiner

CONNECTOR POSITION ASSURANCE (CPA) AND PLUG CONNECTOR ARRANGEMENT HAVING A CPA

This application is a 35 U.S.C. § 371 National Stage Application of PCT/EP2015/055203, filed on Mar. 12, 2015, which claims the benefit of priority to Ser. No. DE 10 2014 206 431.7, filed on Apr. 3, 2014 in Germany, the disclosures of which are incorporated herein by reference in their entirety.

BACKGROUND

The disclosure relates to a CPA (representing the English term "connector position assurance" whereas a direct translation of the German is "plug connector position control" or rather "plug connector control element" or "contact position assurance") having the features of the disclosure and also a plug connector arrangement having a CPA.

CPAs for securing the contact position of a plug housing on a mating plug housing are known from the prior art. CPAs of this type are intended to prevent a plug housing that is latched to a mating plug housing from unintentionally detaching from the mating plug housing, by way of example as a result of vibrations, temperature-dependent expansion or shrinkage, pulling on a cable that is arranged in the plug housing or other mechanical effects. By way of example, in the motor vehicle industry, in particular in the case of safety-relevant components, such as for example air bags, high demands are placed on the reliability of the plug connector arrangement.

A CPA can also provide a haptic feedback to an installer or a machine by means of a specific constructive embodiment so as to indicate whether a plug housing that is provided with the CPA is completely latched to a corresponding mating plug housing. Only after completely latching the plug housing onto the mating plug housing can the CPA then be plugged on into its end position on the plug housing.

DE 60 2005 000 248 T2 discloses a CPA with which the removal of a plug housing from a mating plug housing is impeded in the case of a plugged-in CPA. The CPA is embodied as an elongated transverse bracing member from which a middle section extends in the plugging-on direction and also two elongated actuating resilient sections that are arranged on the left-hand side and right-hand side of the middle section are used as guiding elements. The CPA is consequently similar to a three-pronged fork and extends essentially in a two-dimensional plane.

SUMMARY

The disclosure is based on the knowledge that conventional CPAs having multiple arms are ever more difficult to produce in a safe and reliable manner, for example by means of injection molding methods, owing to the ever increasing demand for miniaturization of the plug connector arrangement. The small dimensions and the slender latching geometries on the CPA arms can lead to high rejection rates when producing the CPAs. Furthermore, in the case of multi-arm, essentially two-dimensional CPAs, there is the risk that the CPAs, which are typically processed in bulk, become entangled with one another and thus either block the production or can damage individual arms, as a result of which the function of the CPA can be impaired. It is becoming increasingly more difficult to insert an ever further miniaturized CPA into the associated interlocking aperture in the case of conventional CPAs and as a result the rejection rate or reworking rate increases and the length of cycle is increased. Furthermore, in the case of conventional CPAs, an interlocking aperture is frequently arranged provided on the outer side of the plug housing and the CPA interlocks with said interlocking aperture. As a result of the interlocking aperture that remains open on the outer side of the plug housing or the mating plug housing, there is the danger of unwanted cable or other objects becoming entangled during the assembly process and of damage or loss of time. Finally, in the case of a fork-shaped embodiment of the CPA, sufficient construction space is to be maintained in the plug housing for a guiding structure for all the arms of the CPA, which runs counter to any efforts to miniaturize the plug housing since the dimensions of the arms ultimately are delimited in the downwards direction by means of the production method, typically in other words the injection molding method. This leads to a widening of the plug housing that runs counter to the miniaturization efforts.

The disclosure provides to make available a CPA wherein the above described disadvantages are advantageously avoided in that the guiding elements that are arranged on the side are replaced by means of a housing that is embodied as a type of guiding sleeve that in the plugged-on state completely surrounds a neck section or slide section of a plug housing of a plug connector arrangement.

In accordance with the disclosure, a CPA or a connector position control element or a contact position assurance is proposed so as to secure the contact position of a plug housing on a mating plug housing. The CPA comprises a housing that can be plugged onto the plug housing in the plugging-on direction. The CPA furthermore comprises an interlocking element for blockinga latching element of the plug housing, wherein the housing of the CPA comprises a through-going aperture, in particular precisely one single through-going aperture, for receiving the plug housing during the plugging process, wherein the interlocking element is arranged on the housing of the CPA and comprises a free end that extends along the plugging-on direction. The interlocking element is offset outwards in a transverse manner with respect to the plugging-on direction with respect to the housing of the CPA. The terms "CPA", "plug connector position control element" and "contact position assurance" are to be used in the context of this application as synonyms.

In addition, a plug connector arrangement having a CPA is proposed. The plug connector arrangement comprises a one-piece plug housing, wherein the plug housing comprises a base section along the plugging-on direction and a slide section or neck section for sliding on the CPA, said slide section or neck section protruding from the base section in the opposite direction to the plugging-on direction.

The term "securing arrangement" is to be understood in the context of this application to mean the arrangement securing against an unintentional detachment of the mechanical or electrical contact between the plug and mating plug or against an unintentional detachment of the latching arrangement of the plug on the corresponding mating plug. This securing arrangement is to secure against both disruptive influences caused by the operation, such as for example vibration, temperature dependent expansion, the effects of aging or similar, as well as mechanical influences by way of example when handling or in the assembly process. It is possible by means of the securing arrangement to continuously maintain the exact position of the contact or the contact position.

In the context of this application, the interlocking element is not to be added to the housing for the spatial delimitation of the housing of the CPA, in particular not in the plugging-on direction, even if the interlocking element is arranged on the housing or even is embodied as one piece with the housing. The interlocking element is also not to increase the dimensions of the wall of the housing.

With respect to the prior art, the CPA in accordance with the disclosure comprises the advantage that the CPA does not determine the installation space for the miniaturized plug connector arrangement. This is because the through-going aperture of the housing for receiving the plug housing can assume the guiding function similar to a guiding sleeve for precisely placing the interlocking element on the plug housing. As a consequence, the laterally protruding arms are omitted and the guiding function is provided by means of the through-going aperture that extends in relation to the interlocking element in the opposite direction to the plugging-on direction, in particular through the precisely one singular through-going aperture for receiving the plug housing. Functional elements of the CPA are transferred by means of the embodiment of the CPA in accordance with the disclosure from the two-dimensional shape of the conventional CPAs into a three-dimensional shape so that the gaps that become ever smaller along a longitudinal section between individual plug contacts can be further reduced, for example to a measurement that is determined by means of the thickness of the cable cross section.

Further advantages of the embodiment in accordance with the disclosure reside in the robust construction of the sleeve-type housing having its through-going aperture since the guiding elements that are arranged on the side can be omitted, which also improves the production reliability. Altogether, the lateral expansion of the CPA can be reduced in this manner with respect to conventional solutions by 20% to 40% or more, as a result of which a miniaturization of contact gaps to a gap as small as the cable cross section is advantageously rendered possible without having to omit a CPA. In particular in the case of small cable cross sections, a miniaturization of contact gaps to as small as 0.5 mm or less, by way of example 0.3 mm, is also possible.

By virtue of the fact that the interlocking element is offset outwards in a transverse manner with respect to the plugging-on direction with respect to the peripheral wall of the housing, the interlocking element can be advantageously reliably produced even in the case of small dimensions in line with a miniaturization procedure. This is because minimum injection molding thicknesses are to be maintained in the case of miniaturized plug connectors and delicate structures that protrude inwards with free ends in the case of miniaturized plug connectors can exceed the limits of manufacturing. Furthermore, the interlocking element is advantageously better protected by means of the interlocking element that is protruding outwards against damage during the plugging-on procedure since said interlocking element slides along an outer wall of the plug housing until the through-going aperture comprises the slide section or the neck section of the plug housing and the interlocking element deflects into the correct position. An interlocking element that is arranged in the interior of the sleeve or through-going aperture and that protrudes along the plugging-on direction beyond the wall can in contrast be pressed gently against fixed elements of the plug housing in the case of an incorrect positioning and in the case of missing the corresponding receiving aperture and as a consequence can be broken or damaged during the plugging-on procedure. Finally, the interlocking element that protrudes outwards and protrudes beyond the wall in the plugging-on direction proves advantageous in that the CPA provides few entrapment sites where entangling can occur. This is because, in contrast to by way of example an interlocking element that protrudes out the interior of the through-going aperture, the through-going aperture of the sleeve-type housing does not provide in this manner entrapment sites where entangling can occur and this through-going aperture of the sleeve-type housing is particularly advantageous when delivering CPAs in bulk in a production procedure.

In contrast to the prior art, the plug connector arrangement in accordance with the disclosure having a CPA comprises the advantage that the CPA can be plugged or slid onto the plug housing in a simple and reliable manner since the through-going aperture of the housing of the CPA can slide as a type of guiding sleeve over the slide section or neck section of the plug housing without tilting or without the possibility of braking or damaging delicate guiding structures.

Advantageous embodiments and further developments of the disclosure are provided by means of the features and measures that are disclosed in the dependent claims.

A further development of the disclosure provides that the through-going aperture is delimited by a circumferential wall of the housing. In other words, the through-going aperture is delimited in this further development by means of an annular closed wall. The wall that extends around the periphery of the through-going aperture of the housing for receiving the plug housing in the manner of a guiding sleeve assumes the guiding function so as to precisely position the interlocking element on the plug housing.

The through-going aperture that is delimited by the peripheral wall and provides the housing with the shape of a sleeve provides in an advantageous manner a peripheral aid when closing or plugging the CPA onto the plug housing and when opening or withdrawing the CPA from the plug housing since the housing can be gripped easily from all sides. The risk of a snap-type rotation during operation is therefore advantageously reduced in contrast to the conventional CPAs with their large aspect ratio with regards to their merely two-dimensional shape. The peripheral wall advantageously produces a relatively large and homogenous operating surface as a result of which the influence of force on the wall is reduced during operation.

In contrast to a wall that is embodied by way of example with a gap in the manner of a snap ring and that delimits the through-going aperture and that can be more easily pushed over an existing cable in a transverse manner with respect to the plugging-on direction, a peripheral wall provides a particularly good protection against entangling with other elements. The term 'peripheral wall' in the context of the application is also to include a sleeve-type wall that comprises two opposite ends that are arranged along a peripheral line that extends around the longitudinal axis, wherein the two ends overlap one another, as for example in the case of a key ring.

Furthermore, in the plugged-on state of the CPA on the plug housing possible plug apertures or injection molding skins or rugged surfaces that are present on the plug housing are advantageously covered by means of the peripheral wall and the shape of a sleeve so that entrapment sites where entangling with other objects can occur are not provided on the plug housing and damage is not caused as a result.

In a further exemplary embodiment, the CPA can be embodied in such a manner that the interlocking element protrudes along the plugging-on direction beyond the peripheral wall of the housing. As a consequence, the interlocking element in a key-like manner can produce a rotationally-secure arrangement of the CPA during the plugging-on process: if the CPA is placed in a rotated manner onto the plug housing, the CPA thus cannot slide on the plug housing since the interlocking element that is protruding beyond the wall can be blocked on the plug housing and as a consequence a further slipping can be prevented. This is a simple and cost-effective poke-yoke solution.

An advantageous further development of the CPA provides that an interior wall of the wall of the housing is facing or is pointing to the through-going aperture and at least one guiding element is arranged so as to axially guide the housing with respect to the plug housing during the plugging-on procedure on the inner wall of the housing. By means of this further development, it is advantageously provided that the CPA cannot be rotated about a longitudinal axis of the plug housing during the plugging-on procedure and that as a consequence the interlocking element can be reliably and safely brought into the correct position without causing damage. In this manner, a secure axial guiding arrangement is provided prior to commencing the plugging-on procedure even if the through-going aperture is embodied in another manner, for example as circular. In addition, further elements advantageously do not protrude from the outer wall of the housing by means of the arrangement of the at least one guiding element on the inner wall of the sleeve-shaped housing and the danger of objects becoming entangled on the outer side of the CPA, for example in the plugged-on state, is minimized.

A further development of the CPA provides that the at least one guiding element protrudes in a transverse manner with respect to the plugging-on direction of the housing from the inner wall into the interior of the housing. The at least one guiding element can be embodied preferably as a rib-shaped protrusion that extends along a longitudinal axis of the housing of the CPA. By means of this further development, it is provided that the at least one guiding element can be inserted in a simple manner with a corresponding recess by way of example in the form of a groove on an outer side of the slide section or neck section of the plug housing and it is thus possible to achieve an axial guiding arrangement that is simple to produce.

By virtue of the fact that the at least one guiding element lies entirely in the region that is surrounded by the inner wall of the housing and in particular does not protrude beyond the wall of the housing in the plugging-on direction, a CPA is provided that advantageously particularly protects against entangling occurring and simultaneously can be reliably plugged on.

A further development of the CPA provides that the peripheral wall of the housing comprises an end face on its end that is located in the opposite direction to the plugging-on direction, said end face being arranged entirely in a plane that is perpendicular with respect to the plugging-on direction. As a consequence, it is advantageously provided that the CPA can connect flush to an end face of the plug housing in the state in which said CPA is plugged onto the plug housing, as a result of which a preferably approximately planar surface is produced. As a consequence, a particularly good protection against entangling occurring is provided and the possibility of dust, dirt or moisture entering the CPA or plug housing is advantageously reduced. Simultaneously, an end face that lies in a plane in this manner provides a particularly small entrapment surface against entangling by way of example in the case of delivering the CPAs in bulk. Furthermore, the production of the CPAs in this manner, by way of example in an injection molding method, is advantageously simple and particularly reliable since delicate, small geometric forms do not need to be embodied on this end of the housing by means of the production process.

One advantageous further development of the CPA provides that the interlocking element is embodied as one piece with the housing. As a consequence, it is possible to produce the CPA in a particularly cost-effective and simple manner in a single production step, by way of example a synthetic material injection molding process or a milling process.

By virtue of the fact that precisely one interlocking element is provided on the housing, it is possible to produce the CPA in a particularly simple and cost-effective manner and the danger of individual CPAs becoming entangled with one another when delivering in bulk is particularly low. Simultaneously, as a consequence, it is provided that the CPA can only be correctly slid onto the plug housing in a single position in a manner similar to a key-lock principle or as a poke-yoke solution. In addition, it is advantageously directly evident during the assembly process whether the CPA is a good part or a reject part. This is because it is only necessary to check the single interlocking element for its completeness or its functionality. As a consequence, the reliability of a plug connection that is provided with a CPA of this type increases.

A further development of the CPA provides that the free end of the interlocking element comprises a protrusion that points inwards in a transverse manner with respect to the plugging-on direction, wherein an outer surface of the protrusion comprises a transverse section that extends in a transverse manner with respect to the plugging-on direction and is set back with respect to an end face of the free end in the opposite direction to the plugging-on direction and an inserting section that connects to said transverse section, said inserting section extending in the opposite direction to the plugging-on direction inclined inwards and a withdrawing section that extends inclined outwards. The free end of the interlocking element in other words comprises a protrusion that points inwards in a transverse manner with respect to the plugging-on direction with respect to the axial extension of the through-going aperture.

By means of this further development, it is advantageously provided that the interlocking element can come into contact with the transverse section initially in a pre-interlocking position on a complementary transverse section or a latching protrusion of a latching element of the plug housing during the procedure of plugging the plug housing on to the mating plug and only in the entirely latched state of the plug housing with the mating plug housing can the interlocking element be displaced by means of the inserting section over the interlocking element away into its end interlocking position. It is rendered possible by means of the withdrawing section that is inclined inwards to advantageously withdraw the CPA from the plug housing in such a manner as to not cause damage and thus to render it possible to reuse the CPA.

A further development of the plug connector arrangement provides that the wall of the housing of the CPA surrounds the slide section of the plug housing in the state in which the plug connector arrangement is plugged entirely onto the plug housing, and an outer surface of the wall or an outer wall of the housing connects flush along the plugging-on direction, in particular flush around the periphery, to an outer surface or outer wall of the base section of the plug housing.

As a consequence, it is advantageously provided that an altogether smooth exterior surface is provided that also advantageously reduces the penetration of dirt or water or fluids in the plug connector arrangement since the entrapment surfaces that are necessary for this purpose, for example gaps, are reduced as much as possible. For example, possible apertures or fissures can thus be covered for example by means of injection molding skins or the like in the plug housing, preferably peripherally covered, as a result of which the risk of objects becoming entangled, such as for example cables or wires, on the plug connector arrangement is reduced.

A further development of the plug connector arrangement having a CPA provides that the end face of the wall that is remote from the interlocking element connects essentially flush to the end of the plug housing that is remote from the base section. As a consequence, an outer shape of the plug connector arrangement is provided that is particularly unlikely to become entangled with anything. Furthermore, by virtue of the fact that the penetration of dust, dirt and moisture is particularly effectively minimized in this manner a particularly small entrapment surface for disruptive influences of this type occurs.

A further development of the plug connector arrangement in accordance with the disclosure provides that a latching device is arranged on an outer side of the plug housing, wherein the latching device comprises at least one rocker-type latching element that can tilt in a transverse manner with respect to the plugging-on direction, wherein the at least one latching element extends along the direction of insertion and comprises a latching protrusion for engaging behind the latching aperture of a mating plug housing, wherein a gap for inserting the CPA, said gap complementing the interlocking element of the CPA, is provided between the latching device and the plug housing. It is advantageously provided by means of this further development that the at least one latching element is detached by means of actuating the rocking-type link from its latched position and the plug housing can be withdrawn from the mating plug housing without causing damage. It is advantageously provided by means of the complementary gap for inserting the CPA that the CPA can be inserted into its interlocking position free of play and that in the plugged-on state of the CPA, particularly few entrapment sites occur where dirt or moisture could penetrate.

A further development of the plug connector arrangement provides that the plug connector arrangement comprises a mating plug housing having a latching aperture and a ramp that protrudes outwards and can be arranged in the opposite direction to the plugging-on direction above the latching aperture, wherein the transverse section of the protrusion of the free end of the interlocking element when plugging together the plug connector arrangement initially comes into contact with the latching protrusion of the at least one latching element and after latching the latching protrusion of the at least one latching element in the latching aperture the latching element of the CPA can be deflected outwards when plugging on further by means of the insertion section by means of the ramp of the mating plug housing so that the CPA can be mounted along the plugging-on direction in its end position. By means of this further development, it is advantageously provided that the CPA can only be plugged into its interlocking end position without increased expenditure with regard to force when the plug housing is correctly latched and plugged together in or on the mating plug housing. As a consequence, an installer is advantageously provided with a haptic feedback as to whether the plug housing is correctly mechanically latched to the mating plug housing. Advantageously, by means of this constructive embodiment, the CPA can be arranged already pre-mounted on the plug housing so that the mounting procedure of plugging the plug housing onto the mating plug housing can be performed in a rapid and reliable manner.

BRIEF DESCRIPTION OF THE DRAWINGS

Embodiments of the disclosure are illustrated in the drawings and are further explained in the description hereinunder.

In the drawings.

DETAILED DESCRIPTION

Figure 1:
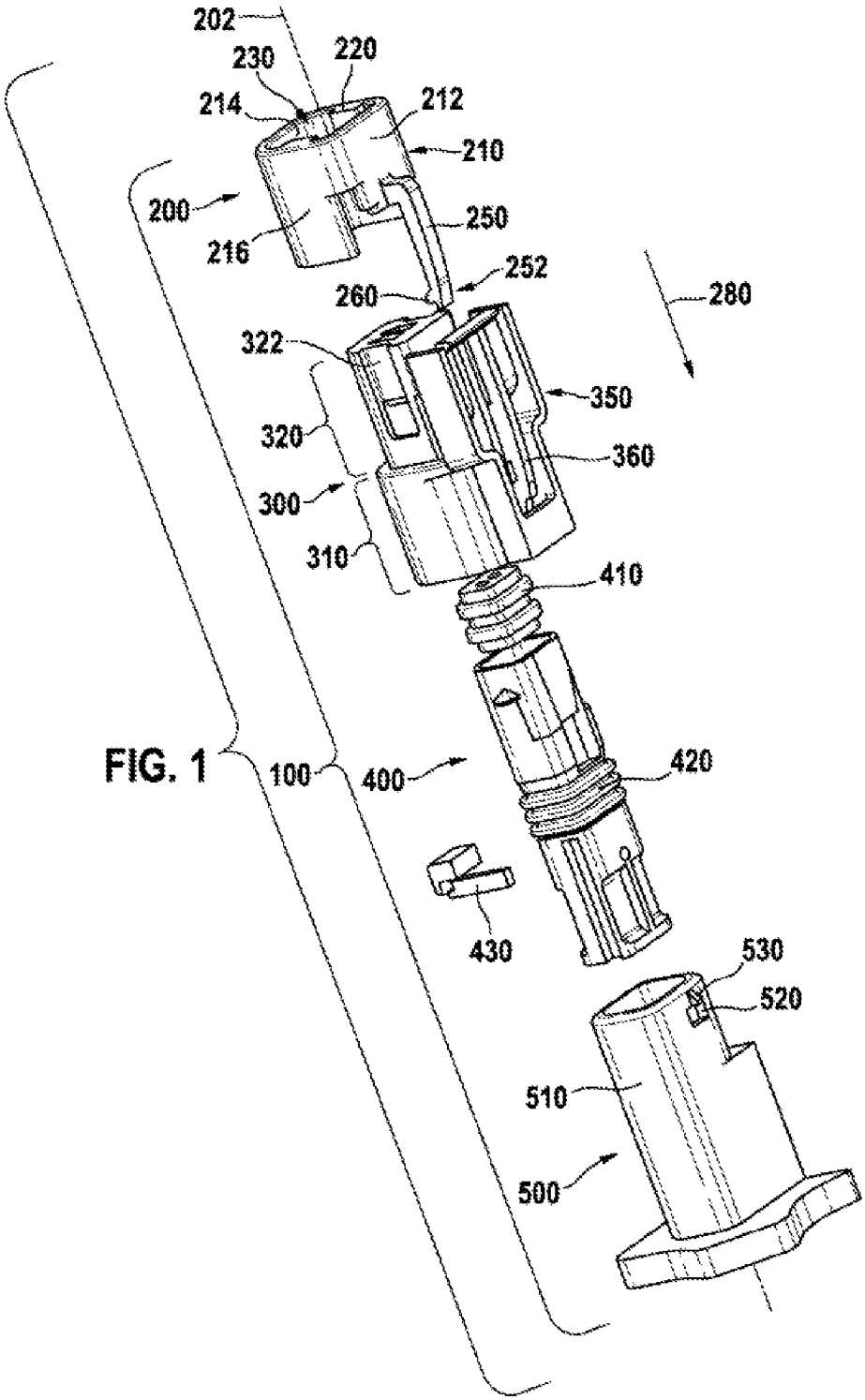
FIG. 1 illustrates an exploded view of a plug connector in accordance with the disclosure.

In the drawings, elements that are referred to by the same reference numerals comprise identical functions.

FIG. 1 illustrates a plug connector arrangement 100 in accordance with the disclosure in an exploded view. The plug connector arrangement 100 comprises a plug housing 300, a CPA 200 and a contact carrier 400 for receiving at least one electrical contact in the interior of the contact carrier 400. The contact carrier 400 can be arranged in the interior of the plug housing 300 and by way of example can be produced separately from the plug housing 300. The contact carrier 400 is only later plugged into the interior of the plug housing 300. The CPA 200 can be plugged-on in a plugging-on direction 280 onto the plug housing 300. The plug housing 300 having the contact carrier 400 arranged within and the plugged-on CPA 200 comprise a common longitudinal axis 202 that extends essentially parallel to the plugging-on direction 280.

The plug connector arrangement 100 furthermore comprises a mating plug 500 or an interface 500 having a mating plug housing 510 or interface housing 510, wherein at least one latching aperture 520 is arranged in the mating plug housing 510. Furthermore, a nose-shaped ramp 530 is arranged on the mating plug housing 510, said nose-shaped ramp being embodied on an upper edge of the mating plug housing 510 when viewed in the inserting direction 280 upstream of the latching aperture 520 and extending in the inserting direction 280. The mating plug 500 is located by way of example on the end of a cable that can be connected for example to a control device, an air bag or a similar device or to a sensor or sensor element.

The contact carrier 400 comprises along the longitudinal axis 202 a longitudinal form. The contact carrier 400 is surrounded approximately centrally by a radial seal 420 that encompasses the periphery of the contact carrier 400 in the plugged-on state and said seal is to prevent by way of example dirt and fluid penetrating into the interior of the mating plug 500. The radial seal 420 seals the contact carrier 400 against the interior of the plug housing 300. A mat seal 410 can be inserted into the contact carrier 400 on the end of the contact carrier that is located opposite the plugging-on direction 280 and the at least one contact (not illustrated) that can be arranged in the contact carrier 400 can be inserted into the interior of the contact carrier 400 in a fluid tight manner by means of said mat seal.

In the plugged together state, the contact carrier 400 is inserted into the interior of the plug housing 300. A contact that can be inserted into the contact carrier 400 can be fastened in a loss-proof manner on the contact carrier 400 by means of a secondary locking element 430 that can be inserted through the contact carrier 400 in a transverse manner with respect to the plugging-on direction 280. The plug connector arrangement 100 is particularly reliably held together by means of the secondary interlocking element 430 and the effect of the CPA is improved.

The plug housing 300 comprises along the plugging-on direction 280 a slide section 320 or neck section 320 that transitions into a base section 310. The base section 310 comprises in cross sections in a transverse manner with respect to the longitudinal axis 202 a larger cross section than the slide section 320 or neck section 320 so that a peripheral line of the slide section 320 lies by way of example entirely within a peripheral line of the base section 310. The cross section of the slide section 320 and the base section 310 is approximately rectangular in the illustrated exemplary embodiment, wherein the rectangular cross section comprises rounded edges. However, an elliptical cross section or a circular cross section is also feasible. In the illustrated exemplary embodiment, guiding grooves 322 are arranged in the slide section 320 on the narrow side of the rectangular cross section, said guiding grooves extending from the upper end of the slide section 320, said end being located in the opposite direction to the plugging-on direction 280, in the axial direction along the plugging-on direction 280 until shortly before the transition of the slide section 320 into the base section 310.

At the base section 310, a latching device 350 is arranged on one of the two longer sides of the rectangular cross section. The latching device 350 protrudes from the base section 310 approximately outwards in a transverse manner with respect to the plugging-on direction 280 and extends starting from the base section 310 in the opposite direction to the plugging-on direction 280 up to the upper end of the slide section 320 or neck section 320. The latching device 350 comprises at least one by way of example elongated latching element 360 that extends along the plugging-on direction 280 along the latching device 350 from the region of the slide section 320 up to the region of the base section 310. A latching protrusion 364 that points inwards towards the longitudinal axis 202 for example in the form of a transverse connecting piece is provided on each of the latching elements 360 for latching in the latching aperture 520. In the illustrated example, two latching elements 360 are provided slightly off center and a gap is located in the center between said latching elements. The gap can be bridged at least one site by a transverse connecting piece, for example the latching protrusion 364 that is embodied as through-going. If the plug housing 300 is pushed onto the mating plug housing 510 in the plugging-on direction 280, the at least one latching element 360 thus latches in the latching aperture 520 of the mating plug housing 510 and thus prevents a simple withdrawal or detachment of the plug housing 300 from the mating plug housing 510.

A gap 354 is provided in a transverse manner with respect to the plugging-on direction 280 between the latching device 350 and the slide section 320, said gap being suitable for inserting the CPA 200 between the slide section 320 and the latching device 350. The latching device 350 is consequently spaced from the slide section 320 or neck section 320 in the region of the slide section 320. The latching device 350 having the latching element 360 is embodied at least in its region pointing to the slide section 320 in such a manner that it can tilt in a rocking manner towards the slide section 320. In other words, as long as the CPA 200 is not plugged onto the slide section 320, the latching device 350 can be tilted by way of example by means of pressure applied by a finger towards the slide section 320, as a result of which the at least one latching element 360 is moved in the region of the base section 310 in a transverse manner away from the base section 310 outwards. In this manner, the two latching elements 360 that are provided and that in the illustrated exemplary embodiment can be moved out of the latching aperture 520 of the mating plug housing and the plug housing 300 can be withdrawn in the opposite direction to the plugging-on direction 280 from the mating plug housing 510.

This possibility of unlocking the latching element 360 or the two latching elements 360 can be prevented by means of plugging on the CPA 200, as a result of which by way of example the risk of the latching element 360 becoming unintentionally unlocked is reduced.

The CPA 200 comprises a housing 210. The housing 210 is embodied in the form of a guiding sleeve in a sleeve-like manner and comprises a peripheral wall 212 that encompasses a through-going aperture 230 for receiving the plug housing 300 during the plugging-on procedure, wherein an inner wall 214 of the wall 212 points to the through-going aperture 230 or the interior of the guiding sleeve. The wall 212 comprises an outer wall 216 that is facing outwards, said outer wall for example being embodied with a smooth surface that is free from apertures.

The housing 210 of the CPA comprises a cross section that is complementary to the slide section 320 of the plug housing 300 in a transverse manner with respect to the plugging-on direction 280, in the illustrated exemplary embodiment consequently a rectangular cross section having rounded edges. In this manner, it is possible to plug the CPA 200 over the slide section 320.

The CPA 200 furthermore comprises an interlocking element 250 that is arranged on the housing 210 and comprises a free end 252 that extends along the plugging-on direction 280 and also an interlocking protrusion 260 that points inwards towards the longitudinal axis 202. It is preferred that only precisely one single interlocking element 250 is arranged on the CPA 200. The interlocking element 250 is offset outwards in a transverse manner with respect to the plugging-on direction 280 with respect to the peripheral wall 212 of the housing 210 of the CPA 200 and protrudes along the plugging-on direction 280 beyond the peripheral wall 212 of the housing 210. The interlocking element 250 is arranged in the illustrated exemplary embodiment on one of the two long sides of the rectangular cross section of the housing 210. However, it can also be arranged on another side wall.

Figure 4A:
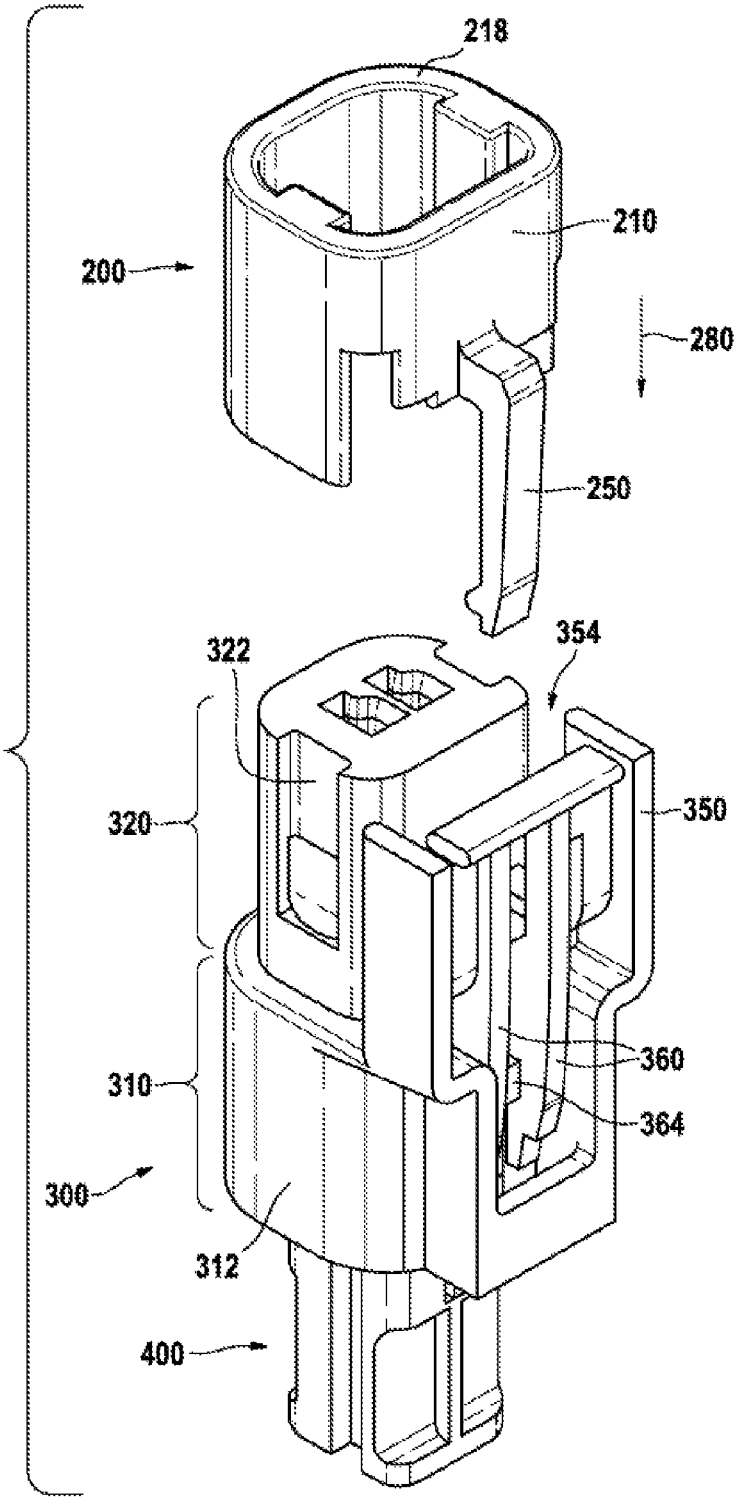
FIG. 4*a* illustrates an exploded view of a CPA in accordance with the disclosure prior to plugging onto a plug housing.
Figure 4B:
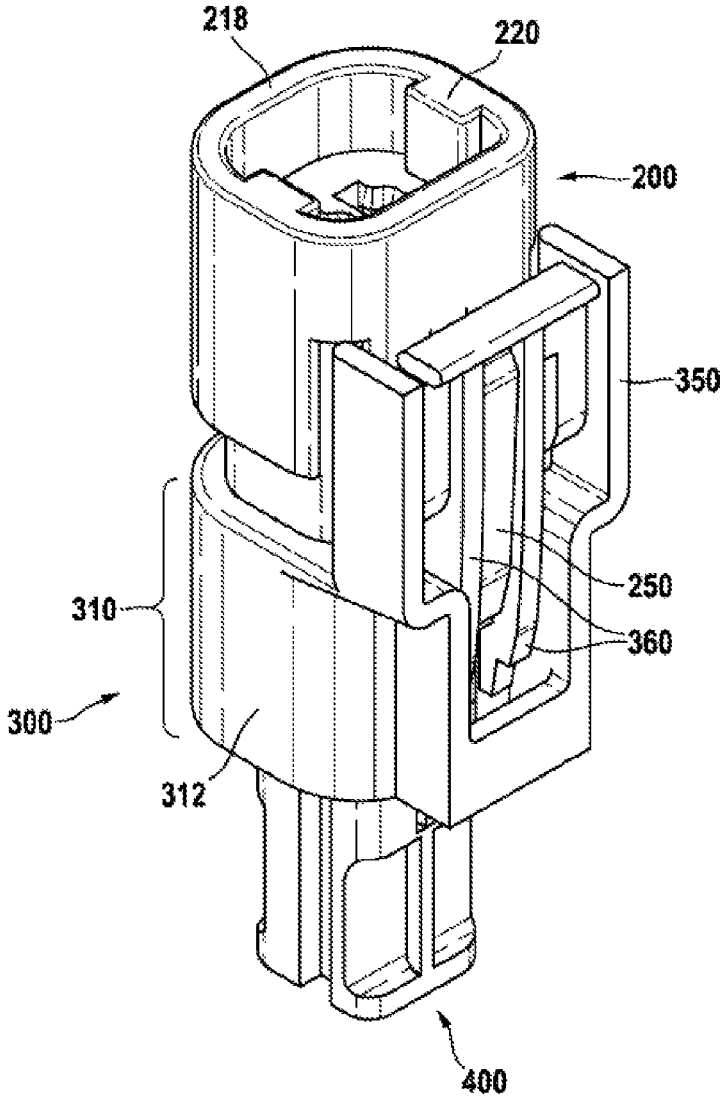
FIG. 4*b* illustrates a perspective view of a CPA in accordance with the disclosure that is plugged onto a plug housing in a pre-pre-interlocking state.
Figure 4C:
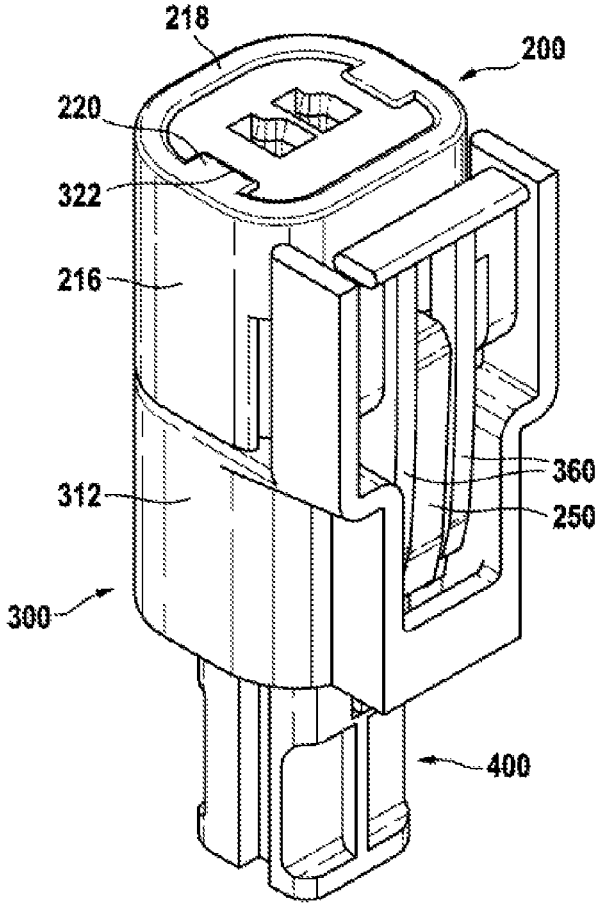
FIG. 4*c* illustrates a perspective view of a CPA in accordance with the disclosure that is plugged onto a plug housing in the end-interlocked position.

When plugging the CPA 200 onto the slide section 320 of the plug housing 300, the wall 212 of the CPA surrounds the slide section 320 of the plug housing 300 entirely, wherein the smooth outer wall 216 of the housing 210, said outer wall being free from apertures, of the plugged together plug connector arrangement 100 provides a planar surface with few possibilities for entangling to occur. The interlocking element 250 simultaneously slides in the gap 354 of the plug housing 300 between the two latching elements 360. In the state in which the latching device is plugged onto the mating plug 500 or the interface 500 and closed or locked, the rocking-type tilting movement of the latching device 350 is effectively blocked by means of the CPA 200 and an unintentional detachment of the latching arrangement is effectively prevented. On the one hand, the part of the wall 212 of the CPA 200 that is arranged between the plug housing 300 and the latching device 350 provides that the rocking-type tilting inwards of the latching device 350 is blocked, which is why the latching elements 360 cannot move in a transverse manner with respect to the plugging-on direction 280 out of the latching aperture 520. On the other hand, the interlocking element 250 likewise blocks the latching elements 360 from moving out of the latching aperture 520 by means of covering the latching elements 360 or a latching protrusion 364 that is illustrated in FIGS. 4*a* to 4*c* and that connects the latching elements 360. Consequently, the wall 212 and the interlocking element 250 can together provide the function of securing the plug housing 300 on the mating plug housing 500. This function can be achieved by means of the embodiment of the CPA 200 whilst simultaneously minimizing the installation space and reducing the complexity of form (only one protruding, delicate element) of the CPA 200.

A guiding element 220 that is embodied as a rib-like protrusion is arranged in each case on the narrow sides of the inner wall 214, said guiding element extending along the plugging-on direction 280. The guiding elements 220 engage during the plugging-on procedure into the guiding grooves 322 of the plug housing 300 and render possible in this manner a secure, rotation-free axial guiding arrangement of the CPA 200. As a consequence, it is ensured that the narrow link-type interlocking element 250 is inserted in a secure and damage-free manner with its delicate free end 252 and the protrusion 260 that is arranged on said free end into the complementary gap 354.

In the context of this application, the term "inwards" is used in connection with a direction that is transverse with respect to the plugging-on direction 280 towards the longitudinal axis 202 and the term "outwards" is used in connection with a direction that is transverse with respect to the plugging-on direction 280 away from the longitudinal axis 202, for example radially outwards.

Figure 2A:
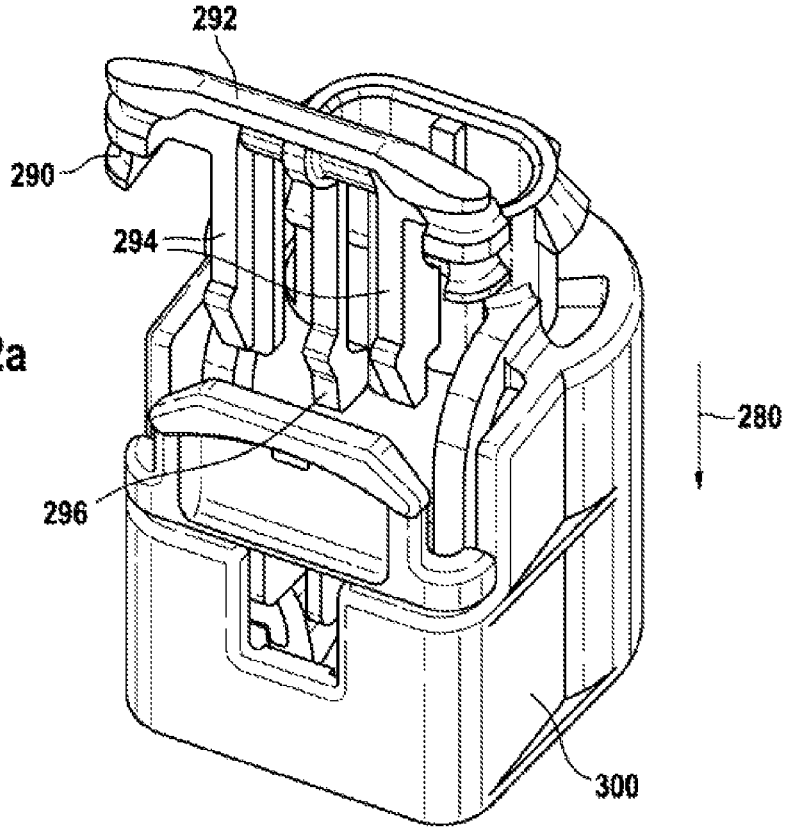
FIG. 2*a* illustrates a perspective view of a plug housing having a CPA in accordance with the prior art.

FIG. 2*a* illustrates a plug housing 300 with a CPA 290 in accordance with the prior art. The CPA 290 is, as is evident in FIG. 2*b*, essentially embodied as a two-dimensional fork-shaped element. The CPA 290 comprises when viewed in the plugging-on direction 280 initially one transverse connecting piece 292 from which an interlocking link 296 protrudes approximately centrally along the plugging-on direction 280. The interlocking link 296 is flanked on both sides by two parallel guiding links 294. The CPA 290 is inserted in a gap of the plug housing 300 along the plugging-on direction 280 wherein the guiding links 294 provide the axial guiding arrangement and the interlocking link 296 provides the interlocking arrangement of a latching element of the plug housing 300. By virtue of the fact that the guiding links 294 and the interlocking link 296 extend from the transverse connecting piece 292 in the same direction, a specific minimum width of the CPA 290 is required. In order to render possible a secure lateral guiding arrangement of the guiding links 294 the plug housing 300 must furthermore be constructed as wider than the CPA 290 or at least than its functional elements 294, 296. This runs counter to an ever continuing miniaturization of the plug housing 300 and CPA 290. In addition, the CPA 290 is difficult to grip owing to its flat-type shape and can be easily rotated during the plugging process about its center axis. In addition, the various links can become entangled with one another or become damaged.

Figure 3A:
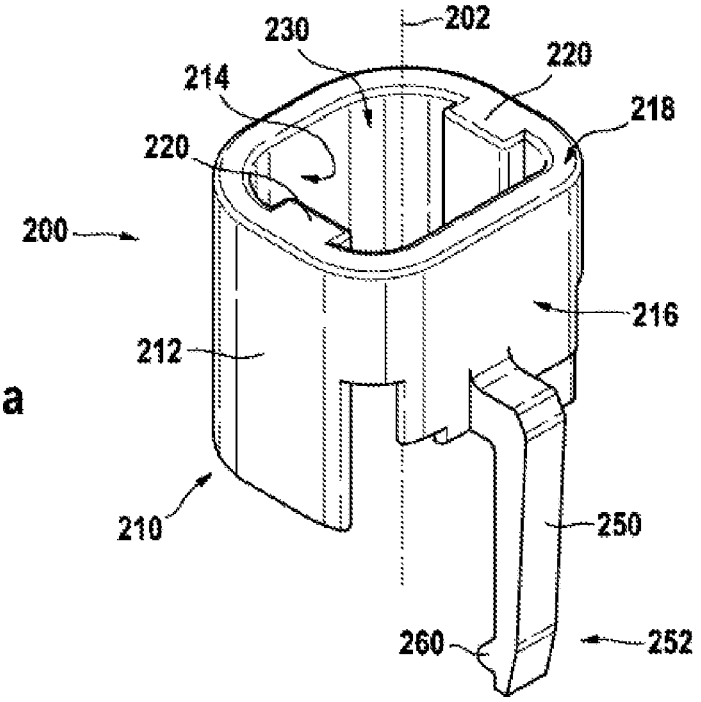
FIGS. 3*a* to 3*d* illustrate various views of a CPA in accordance with the disclosure.

FIGS. 3*a* to 3*d* illustrate an exemplary embodiment of a CPA 200 in various views. FIG. 3*a* illustrates a perspective view of the CPA 200 having its sleeve-type through-going aperture 230 having its peripheral wall 212 and being embodied as a guiding sleeve. The plugging-on direction 280 extends approximately parallel to the longitudinal axis 202 of the through-going aperture 230 of the housing 210. The wall 212 comprises an end face 218 on its upper end that is remote from the interlocking element 250. In a cross section that is transverse with respect to the longitudinal axis 202, the end face 218 lies in a plane, in other words overall at the same height along the plugging-on direction 280. The CPA 200 can thus connect flush to the upper side of the plug housing 300 in the state in which it is plugged onto the plug housing 300.

The interlocking element 250 initially extends from the outer wall 216 of the housing 210 on the longitudinal side of the housing 210 when viewed along the plugging-on direction 280 in the lower region of the housing 210 transversely outwards by approximately one to five wall thicknesses, preferably by one to three wall thicknesses of the wall 212. The interlocking element 250 is then deflected by approximately 90° and extends along the plugging-on direction 280, wherein it protrudes beyond the lower end of the housing 210. The interlocking element 250 protrudes beyond the lower end, in other words a further end face of the wall 212 of the housing 210. This protrusion beyond the lower end extends for example by approximately 30% to 250%, preferably 30% to 150% of the height h of the sleeve-type housing 210 along the plugging-on direction 280.

The guiding elements 220 that are arranged on the narrow sides extend over 10% to 100%, preferably between 20% to 80% of the narrow side and are entirely encompassed by the wall 212. In other words, they protrude neither in the opposite direction to the inserting direction nor along the plugging-on direction 280 beyond the wall 212 of the housing 210. In another embodiment that is not illustrated it is possible that the guiding elements 220 protrude along the plugging-on direction 280 beyond the wall 212 of the housing 210.

Figure 3B:
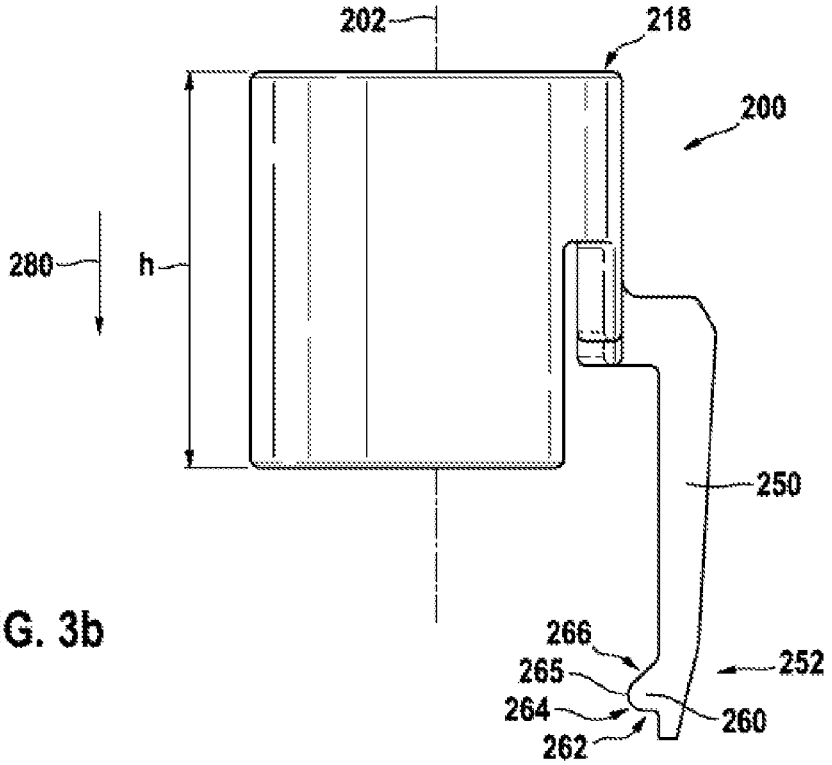
Figure 3C:
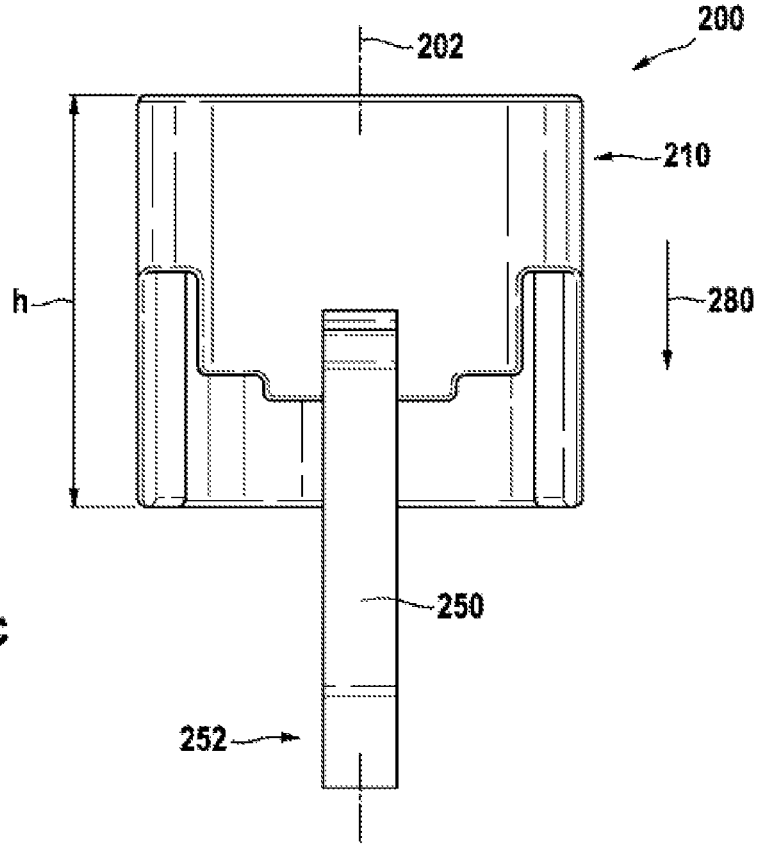
Figure 3D:
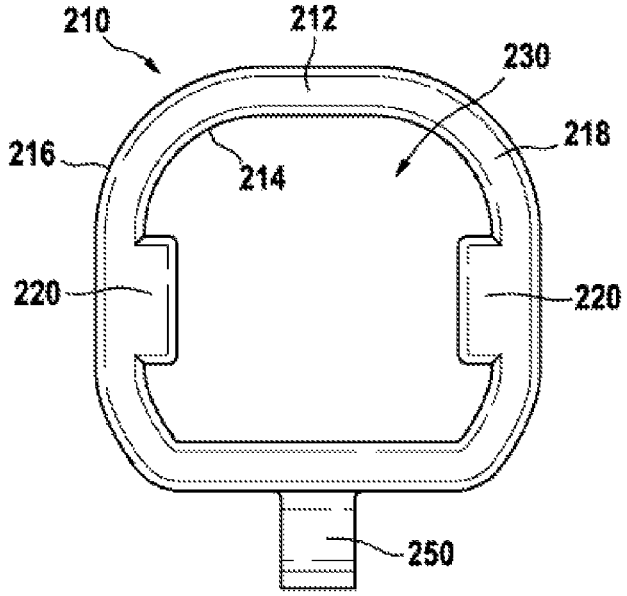

FIG. 3*b* illustrates a side view of the CPA 200. The protrusion 260 that protrudes from the free end 252 pointing inwards towards the longitudinal axis 202 is evident on the free end 252 of the interlocking element 250. The protrusion 260 is set back from an end face of the free end 252 in the opposite direction to the plugging-on direction 280. A transverse section 262 that protrudes inwards is embodied on the lower side of said protrusion that is facing the end face of the free end 252. The transverse section is embodied for the purpose of coming into contact in a pre-interlocking position during the plugging-on procedure in the opposite direction to the plugging-on direction 280 with a corresponding transverse section or the latching protrusion 364 of the latching element 360 or the latching elements 360 of the latching device 350 of the plug housing 300. An inserting section 264 that protrudes inclined inwards and upwards (in other words in the opposite direction to the plugging-on direction 280) connects to the transverse section 262, said inserting section transitioning into a protruding section 265 that extends approximately parallel to the plugging-on direction 280 and connects to a withdrawing section 266 that extends inclined outwards and upwards.

The inserting section 264 is provided for the purpose of displacing the contact securing arrangement 200 in a simple and as much as possible force-free manner into its end interlocking position. For this purpose, the inserting section 264 comes into contact with the ramp 530 of the mating plug housing 510 as soon as the interlocking elements 360 of the plug housing 300 are latched in the latching aperture 520 of the mating plug housing 510. The CPA 200 is pressed in this state along the plugging-on direction 280 and the inserting section 264 thus slides along the nose-shaped ramp 530, wherein the entire interlocking element 250 is pressed outwards in a transverse manner with respect to the plugging-on direction 280. The transverse section 262 that lies on the interlocking element 360 or on the latching protrusion 364 is released by means of this movement outwards and thus no longer blocks the axial movement of the CPA 200 along the plugging-on direction 280. The CPA 200 can consequently be displaced into its end position with little application of force over the ramp 530 and a possible transverse connecting piece or the latching protrusion 364 between the latching elements 360. In this manner, an installer or a machine can also establish whether the correct latching position is achieved since only then can the CPA 200 be pushed without an increased application of force into its end interlocking position.

When removing the CPA 200, the inserting section 266 supports a withdrawing movement. The withdrawing section 266 transforms by means of its withdrawing inclined embodiment an axial movement of the CPA in the opposite direction to the plugging-on direction 280 on the interlocking element 250 into a movement that acts in a transverse manner outwards as a result of which the CPA 200 can become detached from the plug housing 300 in such a manner as to not cause damage.

FIG. 4*a* illustrates the plug housing 300 and the CPA 200 as separate individual parts prior to the two elements being plugged together in a pre-interlocking position.

FIG. 4*b* illustrates the pre-interlocking position of CPA 200 and plug housing 300. In this transverse interlocking position, the CPA 200 cannot move further over the slide section 320 of the plug housing 300 along the plugging-on direction 280 without an increased application of force since the transverse section 262 of the protrusion 260 of the interlocking element 250 lies on a corresponding cross section or the latching protrusion 364 of the latching elements 360. It is evident that, in this pre-interlocking position, the latching device 350 is at least still limited to being able to tilt towards the slide section 320 as a result of which in a state in which said latching device is plugged onto the mating plug housing 510 it would be possible to detach the latching elements 360 from the latching aperture 520. In this position, the interlocking element 250 of the CPA 200 provides the haptic feedback to an installer or a machine. When trying to plug the CPA 200 further in the plugging-on direction 280 onto the plug housing 300, it is possible for the installer or machine to notice that this is not possible without applying considerable force. This is the signal that the plug housing 300 is not yet entirely latched on the mating plug housing 500.

FIG. 4*c* illustrates the CPA 200 and the plug housing 300 in the end interlocked position without the associated mating plug housing 510. The situation illustrated in the figure is normally not possible without the mating plug housing 510; however, the function of the CPA 200 can be clearly seen in the illustration FIG. 4*c*. The wall 212 of the CPA 200 encompasses entirely and in an approximately gap-free manner the slide section 320 or neck section 320 of the plug housing 300 and comes into contact with its end face that is facing the interlocking element 250 on the base section 310 of the plug housing 300. In this state, an outer wall 312 of the base section connects flush to the outer wall 216 of the CPA 200 so that an altogether smooth, continuous surface is present that provides few entrapment points where objects can become entangled or where dirt, moisture or similar can penetrate. The end face 218 of the wall 212 of the CPA 200 likewise connects flush to an end face of the plug housing 300. The wall 212 of the housing 210 and also the interlocking element 250 simultaneously almost entirely fill the gap 354 between the latching device 350 and the slide section 320. The interlocking element 250 grips over the latching elements 360 with its free end 252. A rocking-type tilting of the latching device 350 in a transverse manner with respect to the plugging-on direction 280 towards the slide section 320 is now effectively prevented by means of the wall 212 of the CPA 200 and the interlocking element 250 so that it is no longer possible for the latching elements 360 to unintentionally detach from the latching aperture 520.

In FIG. 4*a* it is clearly evident that in the case of the selected embodiment of the CPA 200 a miniaturization of the plug connector 100 is possible in a simplified manner. This is because by means of the peripheral wall 212 a further outwards protruding wall is not required on the plug housing 300 in order to be able to securely guide the CPA 200. In lieu of this the slide section 320, which is even slightly set back inwards with respect to the base section 310, is used as a guiding structure for the sleeve-type CPA 200. The axial guiding arrangement of the CPA 200 is consequently not arranged parallel in the same direction of extent as the interlocking element 260 but rather extends in the opposite direction to the plugging-on direction 280 from the interlocking element 260. The slide section 320 that is used as a guiding body can be embodied with a smaller diameter than the base section 310 so that the installation space is determined by the base section 310 and no longer by the CPA 200. This is because the functional elements (guiding arrangement and interlocking arrangement) are arranged in different planes and spatial directions. As a consequence, a miniaturization of the plug connector arrangement 100 is advantageously more easily achieved.

Figure 2B:
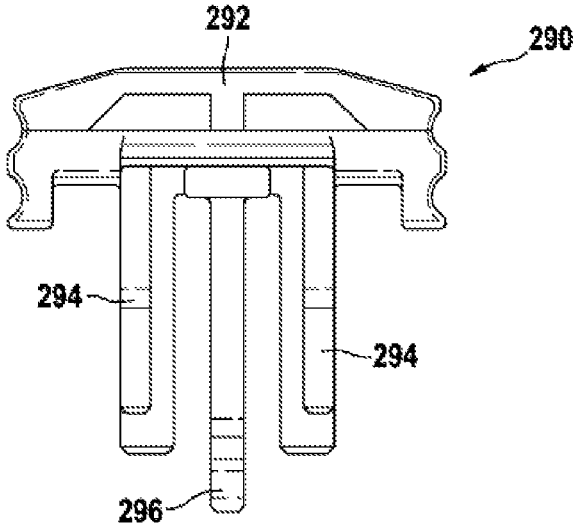
FIG. 2*b* illustrates a plan view of a CPA in accordance with the prior art.

It is likewise clearly evident that the sleeve-shaped CPA 200 can make extensive contact on all outer sides as a result of which the assembly and disassembly of the CPA 200 is considerably simplified. An unintentional rotation of the CPA 200 during the assembly process is effectively suppressed by means of the three-dimensional embodiment, in other words a more balanced aspect ratio in comparison to the planar embodiment of the CPA in accordance with the prior art (FIGS. 2*a* and 2*b*). The CPA 200 also comprises few delicate parts that can become entangled with one another or break when being transported and handled. The sleeve-type embodiment is particularly robust and the risk of damage is low.

Figure 5A:
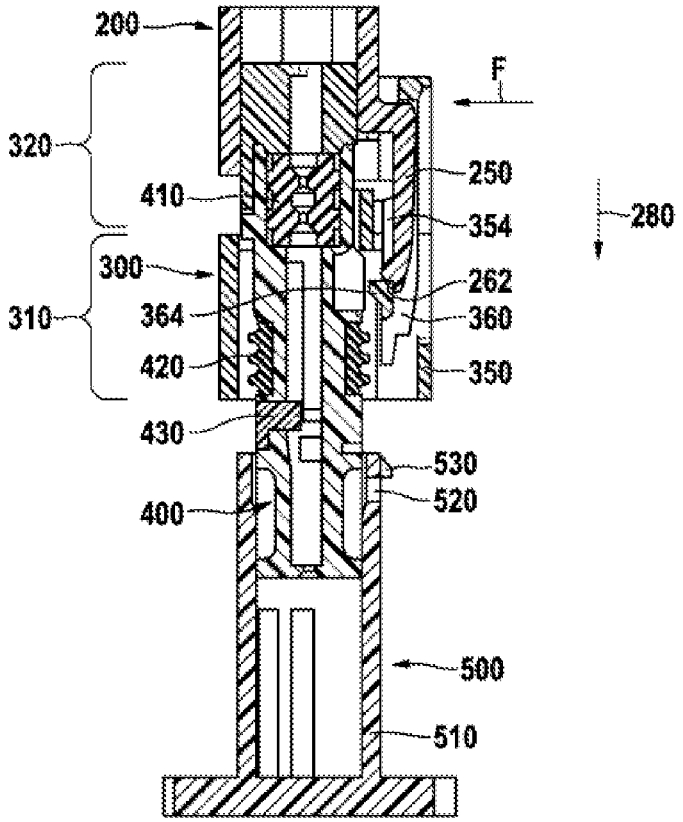
FIGS. 5*a* to 5*c* illustrate cross sections through a CPA that is plugged onto a plug housing in various plugged-on states.

FIG. 5*a* illustrates the interlocking position of CPA 200 and plug housing 300 when plugging onto the mating plug housing 510. In this cross section, the contact carrier 400 that is inserted into the plug housing 300 is illustrated with its radial seal 420 and its mat seal 410, and also the secondary interlocking element 430 that interlocks with or provides a secondary securing arrangement of a contact (not illustrated) in the contact carrier and thereby securely fixes said contact. On the right-hand side of the figure the nose-shaped ramp 530 is evident above the latching aperture 520 on the mating plug housing 510. It is illustrated in the upper part of the figure how the cross section 262 comes into contact with the latching protrusion 364 of the latching element 360. The gap 354 of the latching device 350 is also clearly evident in the sectional view, said gap complementing the latching element 260. In this state, the latching device 350 can also be tilted by means of a force acting along the arrow referred to as "F" against the slide section 320, as a result of which the latching element 360 is deflected outwards in the lower region of the latching device 350.

Figure 5B:
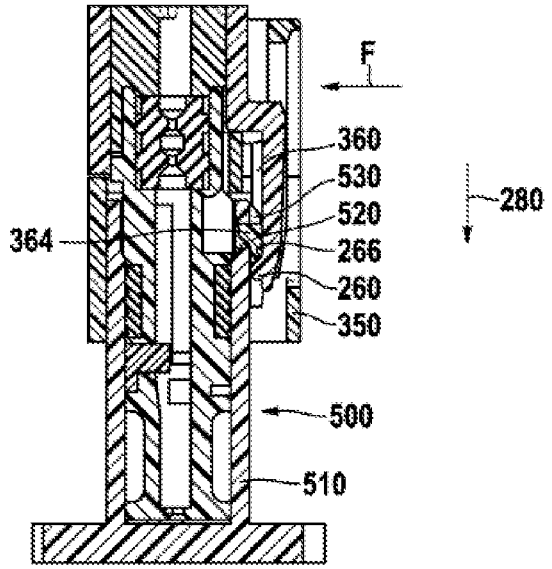
Figure 5C:
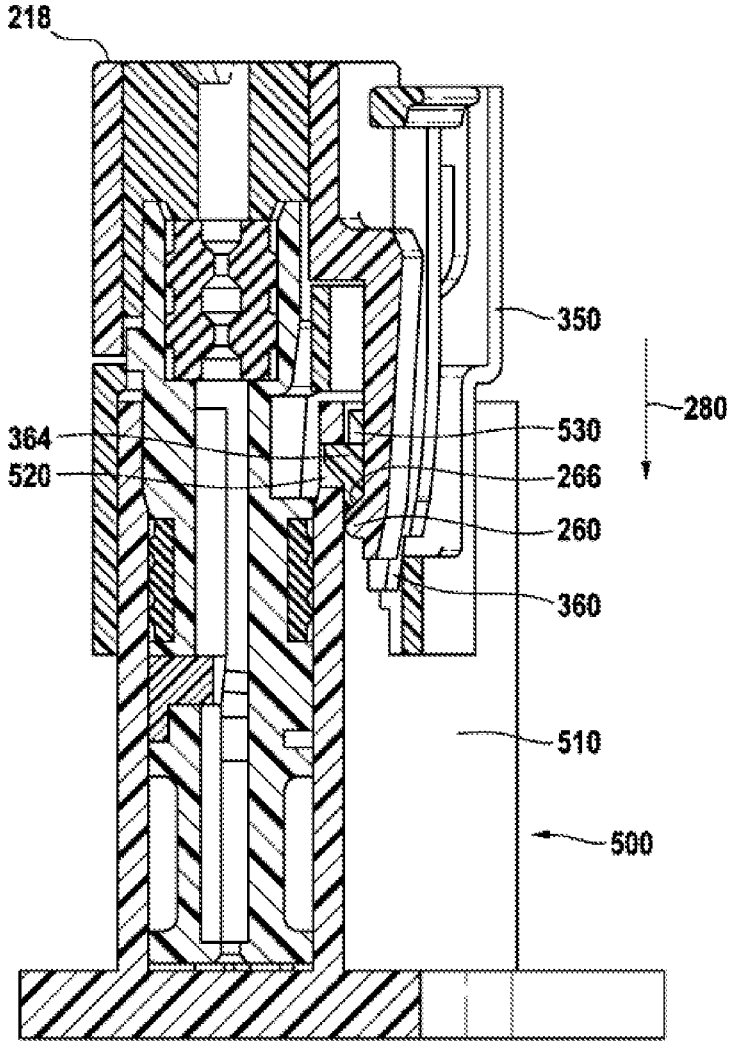

FIG. 5*b* illustrates the end interlocking position. In this state, the latching element 360 latches with its latching protrusion 364 in the latching aperture 520 of the mating plug housing 510. In an intermediate step that is not illustrated, the latching arrangement is already provided, but the CPA has not yet been pushed into its end interlocking position. In this intermediate state, the inserting section 262 of the protrusion 260 lies on the incline of the ramp 530 and can be pressed outwards by means of applying an axial force to the CPA 200 along the ramp 530 and can be displaced into its end position along the plugging-on direction 280. Said inserting section slides initially along the plugging-on direction 280 over the ramp and then over an outward-facing surface of the latching protrusion 364 of the latching elements 360, said latching protrusion being latched in the latching aperture 520. The outward-facing surface of the latching protrusion 364 is eventually covered by the interlocking element 250. In the illustrated section, the ramp 530 and the protrusion 260 are to be viewed as being drawn out of the drawing plane with respect to the latching protrusion 364. This is because the latching elements 360 slide, as can be seen in FIG. 1, during the plugging-on procedure to the left-hand side and right-hand side of the ramp 530 while the interlocking element 260 that lies between said latching elements alone slides over the ramp 530 outwards. This spatial connection is also illustrated in FIG. 5*c*. A tilting of the latching device 350 in a transverse manner with respect to the slide section 320 is blocked in the end interlocking position of FIG. 5*b* by means of the CPA 200.

CPAs or plug connector arrangements of this type are used in all plug connector fields, for example in the construction of motor vehicles. It is particularly advantageous in the case of safety relevant plug connector arrangements for example for the connection of airbags, ESP modules and other assistance systems in motor vehicles or also in low-pole applications, for example in the case of electrically connecting sensors or sensor elements.

The invention claimed is:

1. A connector position assurance (CPA) for securing the contact position of a plug housing on a mating plug housing, comprising:

a housing configured to be slid in a plugging-on direction onto the plug housing, the housing defining a through-going aperture configured to receive the plug housing while the housing is slid onto the plug housing; and an interlocking element configured to block a latching element of the plug housing, wherein the interlocking element (i) is arranged on the housing of the CPA, (ii) includes a free end that extends along the plugging-on direction, and (iii) is offset outwards in a transverse manner with respect to the plugging-on direction with respect to the housing of the CPA.

2. The CPA as claimed in claim 1, wherein the through-going aperture is delimited by a peripheral wall of the housing.

3. The CPA as claimed in claim 2, wherein:

the interlocking element is offset outwards with respect to the peripheral wall of the housing, the peripheral wall defines (i) a foremost end of the housing located in an opposite direction to the plugging-on direction and (ii) a rearmost end of the housing located in the plugging-on direction, and the interlocking element protrudes along the plugging-on direction beyond the rearmost end.

4. The CPA as claimed in claim 1, wherein an inner wall of a peripheral wall of the housing faces the through-going aperture and wherein at least one guiding element configured to axially guide the housing with respect to the plug housing while the housing is slid onto the plug housing is arranged on the inner wall of the housing.

5. The CPA as claimed in claim 4, wherein the at least one guiding element protrudes in a transverse manner with respect to the plugging-on direction of the housing from the inner wall into the interior of the housing.

6. The CPA as claimed in claim 3, wherein the at least one guiding element is embodied as a rib-like protrusion that extends along a longitudinal axis of the housing.

7. The CPA as claimed in claim 4, wherein the at least one guiding element lies entirely in the region that is encompassed by the inner wall of the housing.

8. The CPA as claimed in claim 2, wherein the peripheral wall of the housing comprises an end face on an end that is located in an opposite direction to the plugging-on direction, the end face entirely arranged in a plane that is perpendicular with respect to the plugging-on direction.

9. The CPA as claimed in claim 1, wherein the interlocking element is configured as one piece with the housing.

10. The CPA as claimed in claim 1, wherein the interlocking element arranged on the housing is precisely one interlocking element.

11. The CPA as claimed in claim 1, wherein:

the free end of the interlocking element comprises a protrusion that points inwards in a transverse manner with respect to the plugging-on direction, and an outer surface of the protrusion comprises (i) a transverse section that extends in a transverse manner with respect to the plugging-on direction and is offset with respect to an end face of the free end in an opposite direction to the plugging-on direction, (ii) an inserting section that extends inclined inwards in the opposite direction to the plugging-on direction, and (iii) a withdrawing section that extends inclined outwards, the inserting section connecting to the transverse section and the withdrawing section.

12. A plug connector arrangement, comprising:

a plug housing; and a connector position assurance (CPA) including:

a housing configured to be slid in a plugging-on direction onto the plug housing, the housing defining a through-going aperture configured to receive the plug housing while the housing is slid onto the plug housing, an interlocking element configured to block a latching element of the plug housing, the interlocking element (i) arranged on the housing of the CPA, (ii) including a free end that extends along the plugging-on direction, and (iii) offset outwards in a transverse manner with respect to the plugging-on direction with respect to the housing of the CPA, wherein the plug housing comprises a base section along the plugging-on direction and a slide section that connects to the base section and is configured to plug the CPA.

13. The plug connector arrangement as claimed in claim 12, wherein:

a wall of the housing of the CPA in a state in which the CPA is entirely plugged onto the plug housing encompasses the slide section of the plug housing, and an outer surface of the wall of the housing connects flush along the plugging-on direction to an outer surface of the base section of the plug housing.

14. The plug connector arrangement as claimed in claim 13, wherein the wall has an end face that is remote from the interlocking element and connects essentially flush to an end of the plug housing that is remote from the base section.

15. The plug connector arrangement as claimed in claim 12, wherein:

a latching device is arranged on the plug housing on an outer side, the latching device comprises at least one latching element that is configured to be tilted in a rocking-like manner in a transverse manner with respect to the plugging-on direction, the at least one latching element extends along the plugging-on direction and comprises a latching protrusion configured to engage behind a latching aperture of a mating plug housing, and a gap that is complementary to the interlocking element of the CPA is provided between the latching device and the plug housing and configured to insert the CPA.

16. The plug connector arrangement as claimed in claim 12, further comprising a mating plug housing having a latching aperture and a ramp that protrudes outwards and is arranged in an opposite direction to the plugging-on direction above the latching aperture, wherein:

the free end of the interlocking element of the CPA comprises a protrusion that points inwards in a transverse manner with respect to the plugging-on direction, an outer surface of the protrusion comprises (i) a transverse section that extends in a transverse manner with respect to the plugging-on direction and is offset with respect to an end face of the free end in the opposite direction to the plugging-on direction, (ii) an inserting section that extends inclined inwards in the opposite direction to the plugging-on direction, and (iii) a withdrawing section that extends inclined outwards, the inserting section connecting to the transverse section and the withdrawing section, a latching device is arranged on the plug housing on an outer side, the latching device comprises at least one latching element that is configured to be tilted in a rocking-like manner in a transverse manner with respect to the plugging-on direction, the at least one latching element extends along the plugging-on direction and comprises a latching protrusion, and the transverse section of the protrusion of the free end of the interlocking element initially comes into contact with the latching protrusion of the latching element when plugging together the plug connector arrangement and after latching the latching protrusion of the latching element in the latching aperture the latching element of the CPA is configured to be deflected outwards when plugging on further by the inserting section by the ramp of the mating plug housing so that the CPA is configured to be relocated along the plugging-on direction into an end position.

17. The CPA as claimed in claim 7, wherein the at least one guiding element does not protrude in the plugging-on direction beyond the peripheral wall of the housing.

18. The plug connector arrangement as claimed in claim 13, wherein the outer surface of the wall of the housing connects flush around a periphery to the outer surface of the base section of the plug housing.

19. The CPA as claimed in claim 3, wherein the housing has a height measured between the foremost end and the rearmost end along the plugging-on direction, and wherein the interlocking element protrudes beyond the rearmost end of the housing by at least 30% of the height of the housing.

* * * * *